US007290587B2

(12) United States Patent
Ward

(10) Patent No.: US 7,290,587 B2
(45) Date of Patent: Nov. 6, 2007

(54) DIE THERMAL MANAGEMENT THROUGH COOLANT FLOW CONTROL

(75) Inventor: Gary C. Ward, Saline, MI (US)

(73) Assignee: General Motors Corporation, Detroit, MI (US)

( * ) Notice: Subject to any disclaimer, the term of this patent is extended or adjusted under 35 U.S.C. 154(b) by 62 days.

(21) Appl. No.: 10/929,274

(22) Filed: Aug. 30, 2004

(65) Prior Publication Data

US 2006/0042771 A1 Mar. 2, 2006

(51) Int. Cl.
*B22D 27/04* (2006.01)

(52) U.S. Cl. ..... 164/122; 164/443; 164/348; 137/599.08; 264/40.6; 264/37.27

(58) Field of Classification Search ..... 164/122, 164/443, 348; 137/599.08; 264/40.6, 37.27
See application file for complete search history.

(56) References Cited

U.S. PATENT DOCUMENTS 3,214,153 A * 10/1965 Hauff et al. ..... 165/47
4,120,322 A * 10/1978 Bowles ..... 137/842
5,589,114 A * 12/1996 Evans ..... 264/40.6
5,813,601 A * 9/1998 Priest et al. ..... 236/93 A
6,032,690 A * 3/2000 Weissfloch et al. .... 137/599.08
6,308,931 B1 * 10/2001 Schagunn ..... 251/165
6,312,628 B1 * 11/2001 Wieder et al. ..... 264/37.27
6,698,496 B2 3/2004 Takayama et al.

* cited by examiner

*Primary Examiner*—Kevin Kerns
*Assistant Examiner*—I.-H. Lin

(57) ABSTRACT

A system and method for thermal management of a die is disclosed wherein cooling of the die is controlled by controlling coolant flow to switch between laminar flow and turbulent flow as desired.

15 Claims, 3 Drawing Sheets

DIE THERMAL MANAGEMENT THROUGH COOLANT FLOW CONTROL

FIELD OF THE INVENTION

The invention relates to die casting and more particularly to a system and method for thermal management of a die by controlling coolant flow.

BACKGROUND OF THE INVENTION

In order to control part quality and minimize cycle time, it is necessary to cool a die during a die casting operation. Typically, water or oil have been used as a coolant or cooling medium inside cooling channels in the dies. The coolant extracts heat from the die and the casting material during the die casting cycle. Attempts have been made to control the amount of flow of the coolant to control the amount of heat extracted from the die. In some cases, the flow of coolant has been stopped and restarted to control heat extraction.

The goal in using the coolant is an attempt to attain steady state temperatures to cool the die so the cast material cools in a desired amount of time. Controlling the amount of heat extracted by controlling the amount of flow of the coolant works satisfactorily with castings having a consistent wall thickness. However, undesirable results are obtained where the casting wall thickness varies from thick to thin, or with complex shapes. In this situation, inconsistent cooling occurs where the coolant cools the thin areas quickly and the thick areas slowly. The inconsistent cooling results in cold die casting defects such as cold flow and hot die casting defects such as soldering. Additionally, an area of the casting which is needed to feed pressure to a thicker section of the casting can be prematurely cooled. As a result, shrink porosity can be present in the thicker section of the casting.

It would be desirable to produce a system for thermal management of a die wherein control of heat extracted is maximized.

SUMMARY OF THE INVENTION

Consistent and consonant with the present invention, a system for thermal management of a die wherein control of heat extracted is maximized, has surprisingly been discovered.

In one embodiment, a system for thermal management of a source of heat comprises: a source of coolant; a source of heat having an inlet and an outlet; a flow control valve having an inlet and an outlet, the inlet of the flow control valve in fluid communication with the source of coolant and the outlet of the flow control valve in fluid communication with the inlet of the source of heat, the flow control valve providing laminar flow of a coolant at the outlet thereof; and a bypass conduit providing fluid communication between the source of coolant and the inlet of the source of heat, the bypass conduit facilitating selective bypassing of the flow control valve, a flow through the bypass conduit being turbulent flow.

In another embodiment, system for thermal management of a die comprises: a source of coolant; a die having an inlet and an outlet, the inlet and the outlet connected by a cooling conduit formed in the die; a flow control valve having an inlet and an outlet, the inlet of the flow control valve in fluid communication with the source of coolant and the outlet of the flow control valve in fluid communication with the inlet of the die, the flow control valve providing laminar flow of a coolant at the outlet thereof, a bypass conduit providing fluid communication between the source of coolant and the die, the bypass conduit providing a bypass around the flow control valve, a flow through the bypass conduit being turbulent flow; and a diverter valve in fluid communication with the source of coolant, the diverter valve facilitating selective bypassing of the flow control valve through the bypass conduit.

The invention also provides methods for thermal management of a die.

One method according to the invention comprises the steps of providing a source of coolant; providing a flow control valve having an inlet and an outlet, the inlet of the flow control valve in fluid communication with the source of coolant and the outlet of the flow control valve in fluid communication with an inlet of the source of heat, the flow control valve providing laminar flow of a coolant at the outlet thereof; providing a bypass conduit in fluid communication between the source of coolant and the source of heat, the bypass conduit providing a bypass around the flow control valve, a flow through the bypass conduit being turbulent flow; providing a diverter valve in fluid communication with the source of coolant, the diverter valve facilitating selective bypassing of the flow control valve through the bypass conduit; and causing the coolant to flow as desired through one of the flow control valve to provide laminar flow to the source of heat and the bypass conduit to provide turbulent flow to the source of heat, thus controlling a heat removal rate from the source of heat.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
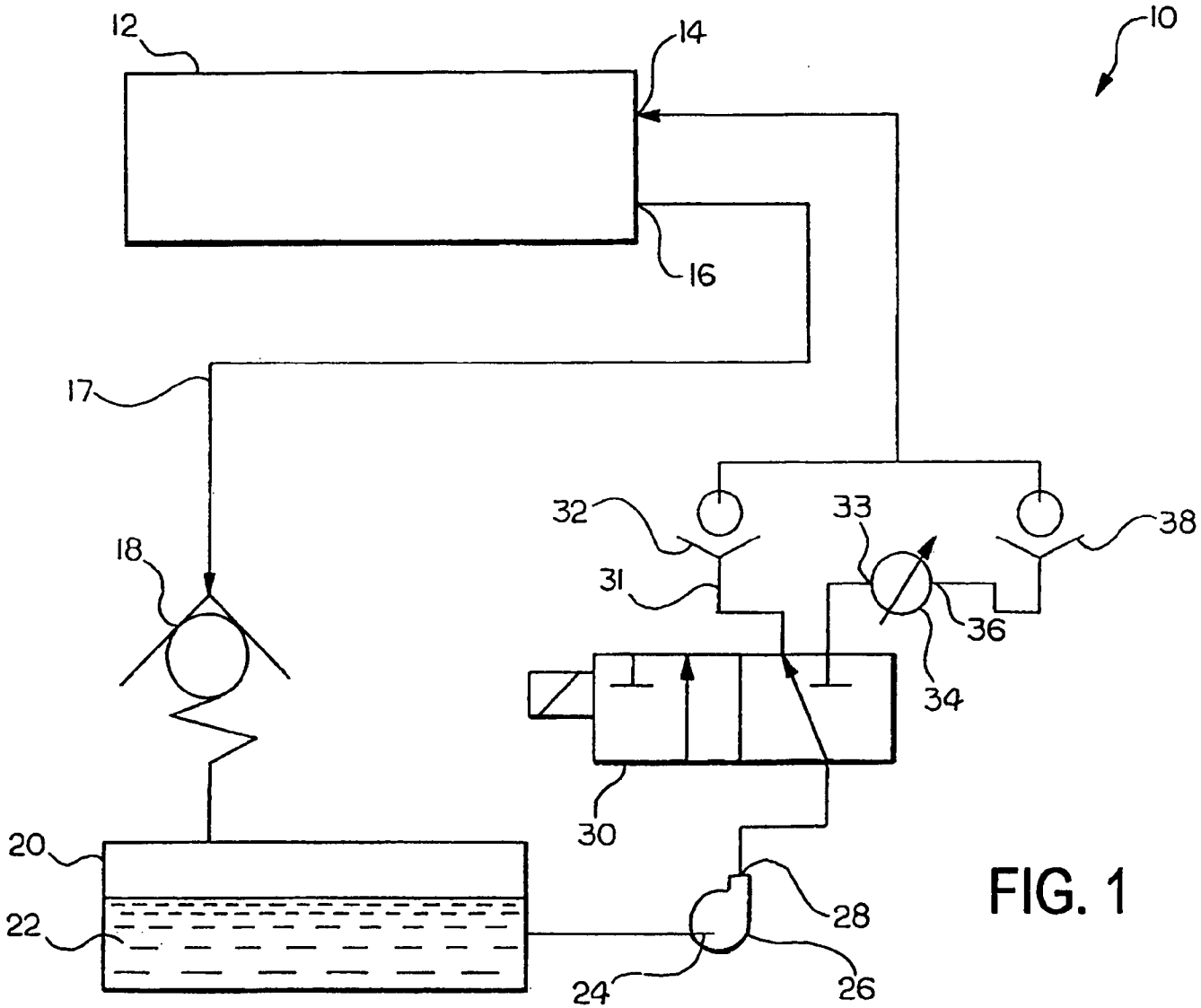
FIG. 1 is a schematic flow diagram showing a system for thermal management of a die according to an embodiment of the invention and showing a diverter valve in a first position.

FIG. 1 depicts a flow diagram showing a system for thermal management of a die 10 according to an embodiment of the invention. A die or source of heat 12, is shown having a coolant inlet 14 and a coolant outlet 16. A return conduit or pipe 17 having a pressure relief valve 18 disposed therein provides fluid communication between the outlet 16 of said die 12 and a source of coolant 20. The pressure relief valve 18 can be any conventional type such as a mechanically operated or electrically or pneumatically operated, for example. The source of coolant 20 includes a coolant fluid 22 disposed therein. The source of coolant 20 can be a tank or reservoir, for example. Alternatively, the return conduit 17 can be in fluid communication with a discharge point (not shown) such as a sewer or waterway. The coolant 22 can be any conventional coolant such as water or oil for example.

A pump inlet 24 of a pump 26 is in fluid communication with the source of coolant 20. The pump 26 may be located at the source of coolant 20 or at a point remote therefrom. It is understood that the pump 26 can be eliminated if the source of coolant 20 delivers the coolant 22 at a pressure sufficient to cause the coolant 22 to flow through the die 12 and the remainder of the system 10 at a turbulent flow rate. A pump outlet 28 is in fluid communication with a diverter valve 30. The diverter valve 30 can be any conventional valve such as a three-way valve or a spool valve, for example, and can be controlled manually or automatically by a controller (not shown). In FIG. 1, the diverter valve 30 is shown in a first position to provide fluid communication between the pump 26 and a first check valve 32. The first check valve 32 is disposed in a bypass conduit or pipe 31. It is understood that any conventional valve or check valve can be used without departing from the scope and spirit of the invention. The first check valve 32 is in fluid communication with the coolant inlet 14 of the die 12.

The first position of the diverter valve 30 also causes an interruption in fluid communication between the pump 26 and an inlet 33 of a flow control valve 34. The flow control valve 34 controls the flow of the coolant 22 to result in laminar flow at an outlet 36 thereof. The flow control valve 34 can be any conventional valve such as a solenoid valve, for example. Additionally, although only one flow control valve 34 is shown, it is understood that more than one valve can be used as desired to result in laminar flow without departing from the scope and spirit of the invention. The flow control valve 34 is in fluid communication with a second check valve 38. The second check valve 38 can be any conventional valve or check valve. The second check valve 38 is in fluid communication with the coolant inlet 14 of the die 12.

Figure 2:
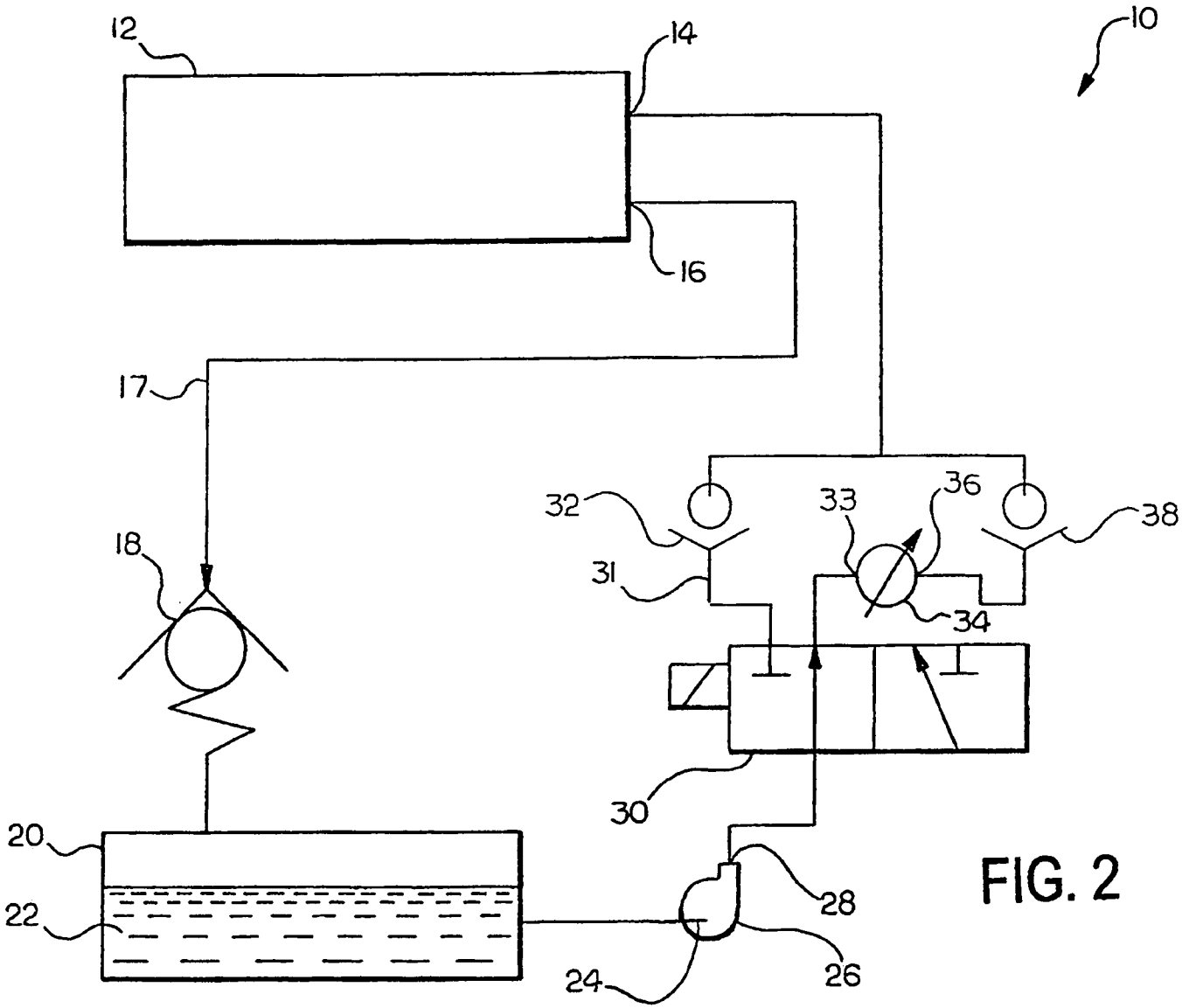
FIG. 2 is a schematic flow diagram showing the system for thermal management of a die illustrated in FIG. 1 showing the diverter valve in a second position.

FIG. 2 shows the system 10 illustrated in FIG. 1 with the diverter valve 30 in a second position. The second position provides fluid communication between the pump 26 and the flow control valve 34. Additionally, the second position of the diverter valve 30 causes an interruption in fluid communication between the pump 26 and the first check valve 32.

Figure 3:
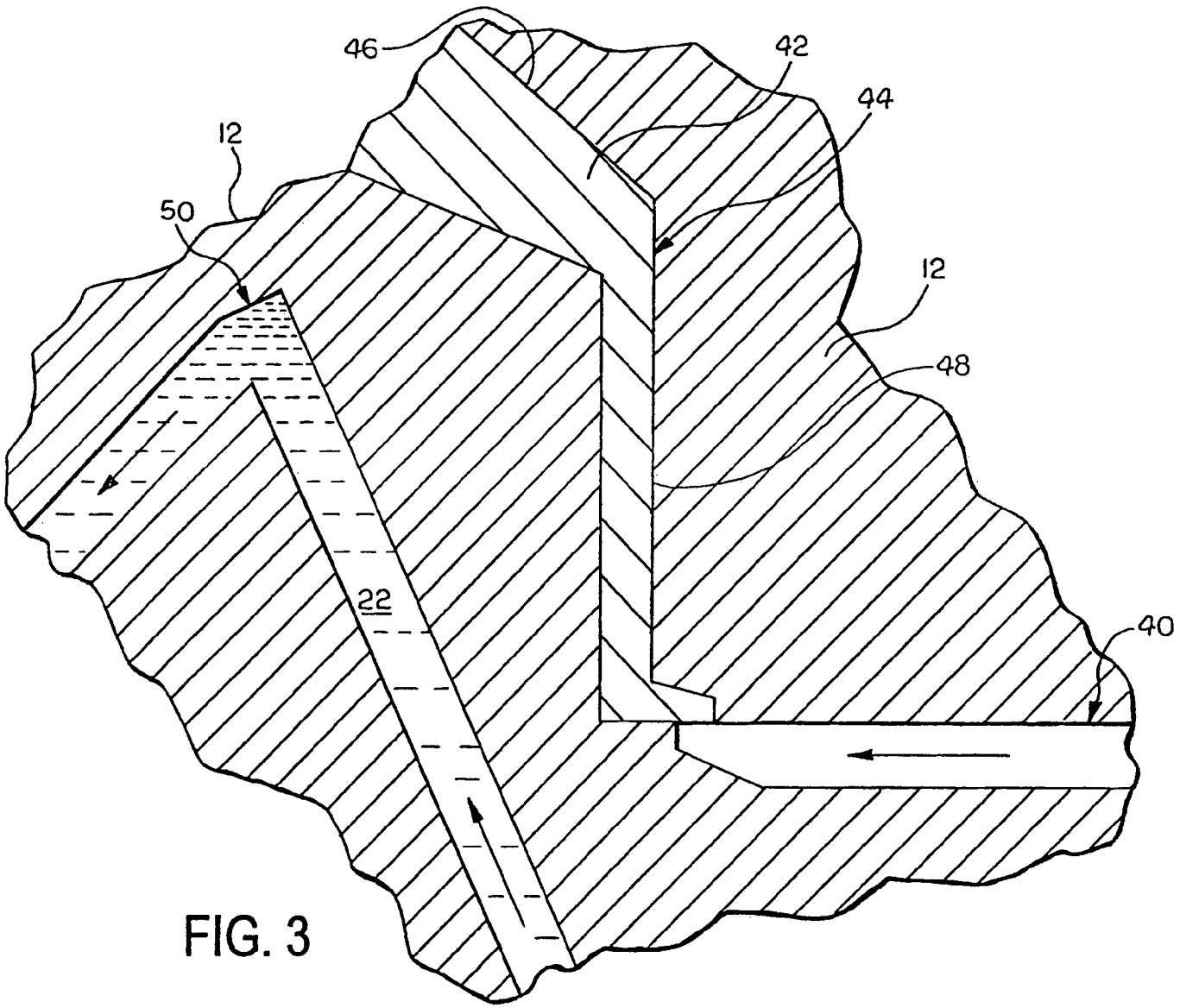
FIG. 3 is a schematic diagram illustrating a portion of a die casting die and showing a conduit for a coolant.

FIG. 3 schematically shows a portion of the inside of the die 12. Molten metal such as aluminum, for example, is introduced through an injection conduit or gating system 40. An injection cylinder (not shown) typically pressurizes the molten metal. A flow direction of the molten metal in the injection conduit 40 is indicated by the arrow. A casting 42 is formed when the molten metal is introduced into a cavity 44 of the die 12. The casting 42 may have areas of varying thickness. In the embodiment shown, the casting 42 includes a thick portion 46 and a thin portion 48. A cooling conduit 50 is formed in the die 12 to convey coolant 22 to areas of the die 12 where cooling is required. A direction of flow of the coolant 22 is indicated by the arrows.

In operation, the system for thermal management of a die 10 circulates the coolant 22 through the die 12 to remove heat therefrom. When it is desired to maximize heat removal from the die 12, the diverter valve 30 is placed in the first position as shown in FIG. 1. The coolant 22 is caused to flow through the diverter valve 30, the bypass 31 including the first check valve 32, the die 12, the return conduit 17 including the pressure relief valve 18, and to the source of coolant 20. Resultant flow through the system 10 with the diverter valve 30 in the first position is turbulent flow. The difference in heat transfer rates from the die 12 is expected to be three to four times greater using turbulent flow versus laminar flow. Thus, heat removal from the die 12 is maximized with the diverter valve 30 in the first position.

When it is desired to minimize the heat removal from the die 12, the diverter valve 30 is placed in the second position as shown in FIG. 2. The coolant 22 is caused to flow through the diverter valve 30, the flow control valve 34, the second check valve 38, the die 12, the pressure relief valve 18, and to the source of coolant 20. The flow control valve 34 causes the flow through the system 10 to be laminar flow. Thus, with the diverter valve 30 in the second position the heat removal from the die 12 is minimized.

Laminar flow can be used, for example, during an open dwell of a die casting machine cycle to reduce the heat removal from the die 12, and retain the heat in the die 12. A return to turbulent flow could be made just prior to the injection of molten metal into the die 12. Turbulent flow would be maintained during the die 12 cooling operation. If it is desired to vary or slow the cooling rate of a casting 42, the flow can be switched from turbulent flow to laminar flow and back to turbulent flow to result in the desired cooling rate.

During operation of the system 10, the pressure relief valve 18 operates to create a backpressure in the die 12 portion of the system 10. The backpressure created militates against the undesirable formation of steam in the die 12.

One use for the system 10 as shown and described herein is where a thin portion 48 supplies a thick portion 46 of a die 12 as shown in FIG. 3. The coolant 22 can be switched from turbulent flow to laminar flow to militate against over cooling of the thin portion 48.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A system for thermal management of a die for die casting of metal comprising:

a source of coolant (20);

a source of heat (12) having an inlet (14) and an outlet (16);

a flow control valve (34) having an inlet (33) and an outlet (36), the inlet (33) of said flow control valve (34) in fluid communication with said source of coolant (20) and the outlet (36) of said flow control valve (34) in fluid communication with the inlet (14) of said source of heat (12), said flow control valve (34) providing laminar flow of a coolant (22) at the outlet (36) thereof; and a bypass conduit (31) providing fluid communication between said source of coolant (20) and the inlet (14) of said source of heat (12), said bypass conduit (31) facilitating selective bypassing of said flow control valve (34), a flow through said bypass conduit (31) being turbulent flow.

2. The system according to claim 1, further comprising a return conduit (17) providing fluid communication between the outlet (16) of said source of heat (12) and said source of coolant (20).

3. The system according to claim 2, wherein said return conduit (17) includes a pressure relief valve (18) disposed therein.

4. The system according to claim 1, further comprising a pump (26) in fluid communication with said source of coolant (20) to pump the coolant (22) from said source of coolant (20) to said source of heat (12).

5. The system according to claim 1, further comprising a diverter valve (30) to facilitate selective bypassing of said flow control valve (34).

6. The system according to claim 1, wherein said source of heat (12) is a die (12).

7. A system for thermal management of a die for die casting of metal comprising:

a source of coolant (20);

a die (12) having an inlet (14) and an outlet (16), the inlet (14) and the outlet (16) connected by a cooling conduit (50) formed in said die (12);

a flow control valve (34) having an inlet (33) and an outlet (36), the inlet (33) of said flow control valve (34) in fluid communication with said source of coolant (20) and the outlet (36) of said flow control valve (34) in fluid communication with the inlet (14) of said die (12), said flow control valve (34) providing laminar flow of a coolant (22) at the outlet (36) thereof;

a bypass conduit (31) providing fluid communication between said source of coolant (20) and said die (12), said bypass conduit (31) providing a bypass around said flow control valve (34), a flow through said bypass conduit (31) being turbulent flow; and a diverter valve (30) in fluid communication with said source of coolant (20), said diverter valve (30) facilitating selective bypassing of said flow control valve (34) through said bypass conduit (31).

8. The system according to claim 7, further comprising a return conduit (17) providing fluid communication between the outlet (16) of said die (12) and said source of coolant (20).

9. The system according to claim 8, wherein said return conduit (17) includes a pressure relief valve (18) disposed therein.

10. The system according to claim 7, further comprising a pump (26) in fluid communication with said source of coolant (20) to pump the coolant (22) from said source of coolant (20) to said die (12).

11. A method for thermal management of a die for die casting of metal, the method comprising the steps of:

providing a source of coolant (20);

providing a flow control valve (34) having an inlet (33) and an outlet (36), the inlet (33) of the flow control valve (34) in fluid communication with the source of coolant (20) and the outlet (36) of the flow control valve (34) in fluid communication with an inlet (14) of the source of heat (12), the flow control valve (34) providing laminar flow of a coolant (22) at the outlet (36) thereof;

providing a bypass conduit (31) in fluid communication between the source of coolant (20) and the source of heat (12), the bypass conduit (31) providing a bypass around the flow control valve (34), a flow through the bypass conduit (31) being turbulent flow;

providing a diverter valve (30) in fluid communication with the source of coolant (20), the diverter valve (30) facilitating selective bypassing of the flow control valve (34) through the bypass conduit (31); and causing the coolant (22) to flow as desired through one of the flow control valve (34) to provide laminar flow to the source of heat (12) and the bypass conduit (31) to provide turbulent flow to the source of heat (12), thus controlling a heat removal rate from the source of heat (12).

12. The method according to claim 11, further comprising the step of providing a return conduit (17) between an outlet (16) of the source of heat (12) and the source of coolant (20) providing fluid communication therebetween.

13. The method according to claim 11, further comprising the step of providing a pressure relief valve (18) disposed in the return conduit (17) to militate against formation of steam in the source of heat (12).

14. The method according to claim 11, further comprising the step of providing a pump (26) in fluid communication with the source of coolant (20) to pump the coolant (22) from the source of coolant (20) to the source of heat (12).

15. The method according to claim 11, further comprising the step of forming a cooling conduit (50) in the die (12).

* * * * *